United States Patent [19]

Morse et al.

[11] Patent Number: 4,746,310

[45] Date of Patent: May 24, 1988

[54] ELECTRICAL CONNECTOR HAVING TRANSIENT SUPPRESSION AND FRONT REMOVABLE TERMINALS

[75] Inventors: Ronald W. Morse; Leonard A. Krantz, Jr.; Richard L. Paul, all of Sidney, N.Y.

[73] Assignee: Amphenol Corporation, Wallingford, Conn.

[21] Appl. No.: 926,741

[22] Filed: Nov. 3, 1986

[51] Int. Cl.[4] ..... H01R 13/66

[52] U.S. Cl. ..... 439/620; 333/185; 439/695

[58] Field of Search ..... 339/147 R, 147 P; 333/181, 182, 183, 184, 185; 411/518; 439/608, 620, 695

[56] References Cited

U.S. PATENT DOCUMENTS 4,170,918 10/1979 Burge ..... 81/176.15
4,405,274 9/1983 Saitoh et al. ..... 411/518
4,494,092 1/1985 Griffin ..... 339/147 R
4,648,681 3/1987 Pass et al. ..... 339/147 R

FOREIGN PATENT DOCUMENTS 2014804 8/1979 United Kingdom ..... 339/147 R

*Primary Examiner*—Gil Weidenfeld
*Assistant Examiner*—Gary F. Paumen
*Attorney, Agent, or Firm*—Bacon & Thomas

[57] ABSTRACT

An electrical connector has a removable dielectric insert sized to fit within the forward opening of the connector shell with internal threads in the shell being threadably engaged by an external threads on a locking nut threadably inserted into the shell to abut the insert. A retaining ring is snapped into an annular recess of the insert to captivate the nut on the insert and provide a surface to aid in retraction of the insert. The terminals are two piece with a rearward portion being nonremovably retained within the shell and the forward portion having a circuit component thereon which can be replaced when the insert is removed.

5 Claims, 2 Drawing Sheets

ELECTRICAL CONNECTOR HAVING TRANSIENT SUPPRESSION AND FRONT REMOVABLE TERMINALS

This invention relates to an electrical connector having transient suppression and front removable terminals.

Electrical connectors in some environments must be protected from electromagnetic interference (EMI) as well as from high voltage spikes such as electromagnetic pulses (EMP) from nuclear blasts and electrostatic discharges (ESD). Providing a connector which is inexpensive yet which meets the need of many users oftentimes depends on predicting the phenomena as well as defining the environment. Once the environment is known or the use changes the required circuit protection is established. Customizing each connector to a specific environment would be expensive and many presently available connectors are hermetically sealed so that once installed in the field repair or removal of individual terminals is all but impossible. Desirably then a connector should permit removability and repairability of the connector terminals as well as changing the arrangement for protecting the circuit.

This invention contemplates an electrical connector comprising a metallic sheel having a front and a rear end portion, a plurality of terminals each disposed in the shell and having a forward end portion for mating, means for grounding the terminals to the shell, circuit protection means electrically connected to the grounding means for protecting the terminals from overvoltages and or frequency interference, and means for allowing selective removal of individual terminals from the connector.

In accordance with this invention the removal means is characterized by the front end portion of the shell being internally threaded and having an internal shoulder circumjacent to the thread and facing forwardly, a dielectric insert having an array of passages each extending between its opposite end faces and receiving the forward end portions of the terminals, the insert having one endface being adapted to abut against the shoulder, and an externally threaded cylindrical locking nut being adapted to threadably engage the shell thread. The insert and nut are inserted into the shell with the insert seating against the shoulder and the nut threadably abutting with the shell and being brought into abutment against the other endface of the insert. A retaining ring is releasably mounted onto the insert to prevent the nut from backing off.

The terminals include a forward and a rearward end portion each being separable from one another, the rearward portions being nonremovably mounted in the shell rear end portion and the forward end portions being disposed in the shell front end portion and selectively removable therefrom when the insert is removed. In particular, the rearward end portion includes a filter element (e.g., a capacitor ferrite sleeve) to provide EMI protection and the forward end portion includes a circuit component (e.g., a silicon diode) to provide protection against voltage spikes (e.g., EMP).

The locking nut is provided with angularly spaced L-shaped keyways each extending inwardly from one annular endface thereof to aid in assembly and/or removal of the nut into the shell. A special tool is provided for installation and removal of the locking nut. The tool comprises a tubular sleeve having angularly spaced L-shaped keys each extending forwardly from the sleeve and configured for receipt by the keyways. Interfitting of the keys into their respective keyways and rotating the sleeve drives the locking nut inwardly or outwardly of the shell. Seating the foot of each key into the foot of its keyway accompanied by axial retreat of the tool attaches to tool to the locking nut and pulls the locking nut and insert outwardly of the shell.

Being front removable is advantageous in that during servicing of the connector in the field, the connector shell need not be removed from its mounting panel or the rear terminations, which oftentimes are effectively positioned behind inaccessible hardward, are undisturbed.

The invention will now be described, by way of example, with reference to the following drawings in which.

Figures 1, 2:
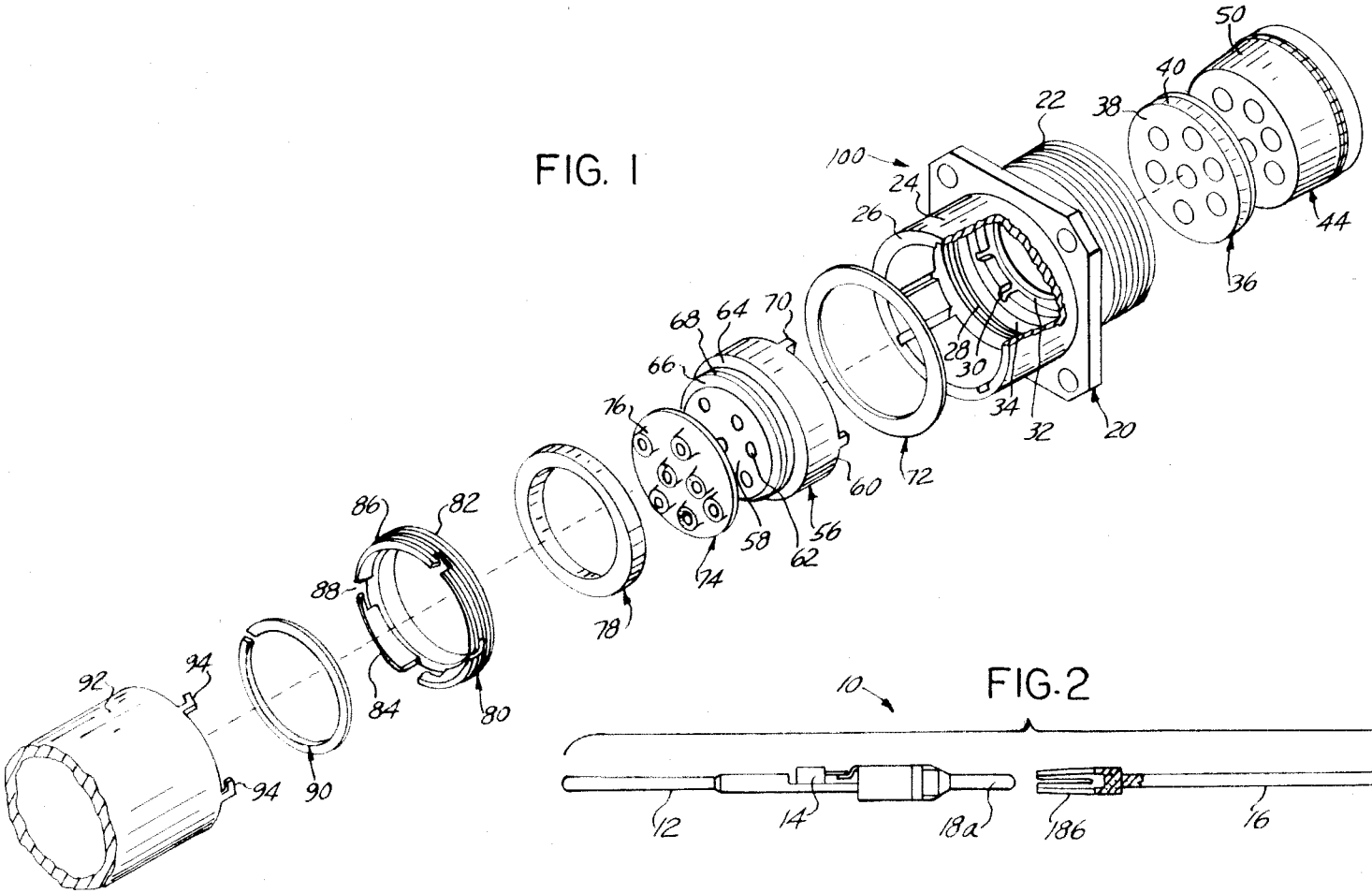
FIG. 1 is an exploded assembly view of a receptacle shell.
FIG. 2 shows a terminal.

Turning now to the drawings, FIG. 1 is an exploded assembly view of a receptacle connector 100 for mating with a plug connector (not shown) to form a connector assembly. The receptacle connector includes a cylindrical metal shell 20 having a rear end portion 22 and a front end portion 24 and carrying a plurality of terminals 10 (see FIG. 2) each having, respectively, a forward end portion 12 disposed in the front end portion of the shell and a rearward end portion 16 disposed in the rear end portion of the shell.

The rear end portion 22 of the shell defines an opening for receiving a grounding assembly 36 and a capacitor assembly 44.

The front end portion 24 of the shell defines an opening for receiving a dielectric insert 56 for insulatively separating the terminal forward end portions 12, an O-ring 72 for sealing about the insert and shell, a rubber interfacial seal 74 for sealing the front endface of the insert and around terminal end portion 12, a rubber gasket 78 for sealing around the inner wall of the shell, a cylindrical externally threaded locking nut 80, and a retaining ring 90.

A tubular tool 92 having angularly spaced L-shaped keys 94 extending forwardly therefrom is used to drive the locking nut into or outwardly from the shell when access to the terminals is desired. The L-shaped keys are used to lock the insert nut to the tool so that the insert assembly can be pulled from the connector.

The shell front end portion 24 has internal thread 28 rearwardly of its front end face 26 circumjacent to a forwardly facing shoulder 32. Cooperating with the shoulder are one or more slots 30 for preventing relative rotation of the insert 56 with respect to the shell. Adjacent to the slots on the inner wall of the shell is an annular groove 34 to receive the O-ring 72.

The dielectric insert 56 is generally cylindrical and includes a a shoulder 64, pair of endfaces 58, 60 and an array of passages 62 extending between the endfaces for receiving the mating forward end portions 12 of the terminals 10, the endfaces and shoulder being in parallel planes each perpendicular to an axis through the primary axis of the shell. The outer periphery of the insert is sized to clearance fit into the shell such that endface 60 abuts against the shoulder 32 of the shell and the other endface 58 is facing forwardly. Tabs 70 extend from the insert for keying the insert relative to the shell. A cam 66 is described adjacent to the forward endface 58 in that a frusto-conical annular surface transitions between the outer periphery of the insert and the front end face. Rearwardly of the front end face 58 is an annular recess 68 sized to receive the retaining ring 90.

The O-ring 72 is adapted to be received in the annular groove 34 to form a moisture seal between the outer periphery of the insert and the inner wall of the shell.

The interfacial seal 74 is bonded to the front endface 58 of the insert 56 and includes an array of apertured towers 76 each being aligned with one passage and sealing about one terminal forward end portion 12.

The gasket 78 forms a moisture seal about the inner wall of the shell when coupled to a mating connector.

The locking nut 80 is cylindrical, has opposite axial endwalls 82, 88, and is provided with thread 86 on its outer periphery, the external thread being adapted to engage with the internal thread 28 in the shell inner wall such that threadable advance of the locking nut will drive the axial endwall 82 against shoulder 64 on the insert. The other axial endwall 84 is provided with angularly spaced L-shaped keyways 88 which are engaged by the keys 94 with rotation of the sleeve 92 (or otherwise) driving the locking nut inwardly or outwardly from the shell.

The retaining ring 90 is adapted to be forced over the annular cam 66 of the insert 56 whereby to be firmly received in the annular recess 68 therearound and seat against the locking nut whereby to allow the locking nut to press against its surface as a reaction surface for the nut which will allow the threads to pull the insert from the shell.

FIG. 2 shows the terminals 10 in accordance with this invention. The forward end portion 12 of each terminal is separable at **18*a* (shown here as being a pin) from its rearward end portion at 18*b* (shown here as being a socket). The forward end portions are disposed in the shell front end portion and include circuit protection means for protecting the terminal from overvoltages or frequency interference (shown here as comprising a silicon diode 14), and the rearward end portions 16 are non-removably mounted in the capacitor assembly 44 in the sheel rear end portion. Removal of the insert 56** exposes and provides access to the terminal rearward end portions for inspection or removal. A new forward end portion may then be inserted into the connector, possibly changing the silicon diode.

Figure 3:
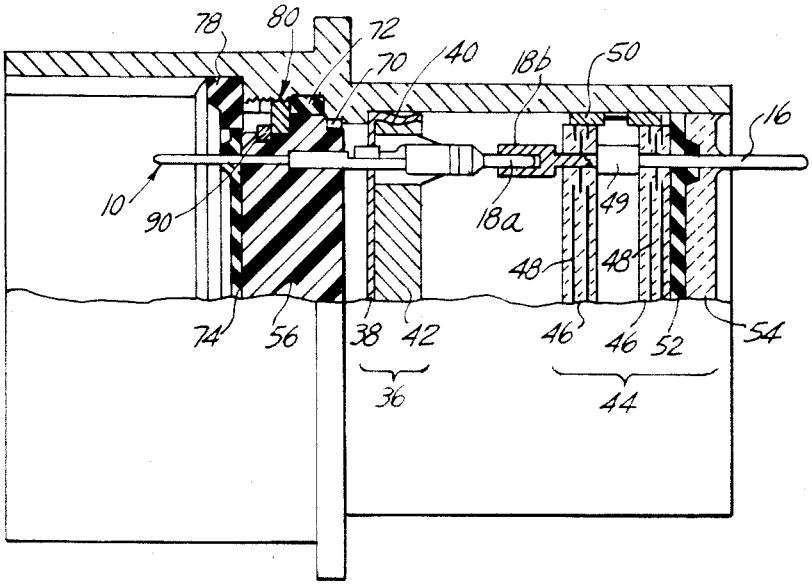
FIG. 3 is a half section side view fo the assembled receptacle shell.

FIG. 3 is a half section side view of the assembled receptacle shell. The grounding assembly 36 includes a bottle cap shaped grounding spring 38 sized to receive an apertured metallized wafer 42 and having spring fingers 40 to complete a ground path between the terminal forward end portions 12 and the shell 20.

The capacitor assembly 44 includes a pair of monolithic planar capacitors 46 each having ground and active electrodes, respectively, connected to the shell and the terminal rearward end portions, a ferrite sleeve 49 disposed around the terminal rearward end portion and sandwiched between the capacitors, a grounding spring 50 interconnecting the capacitors to the shell, a seal 52, and epoxy 54 non-removably securing the rearward end portions 16 of the terminals in the shell rear end portion.

Figure 4:
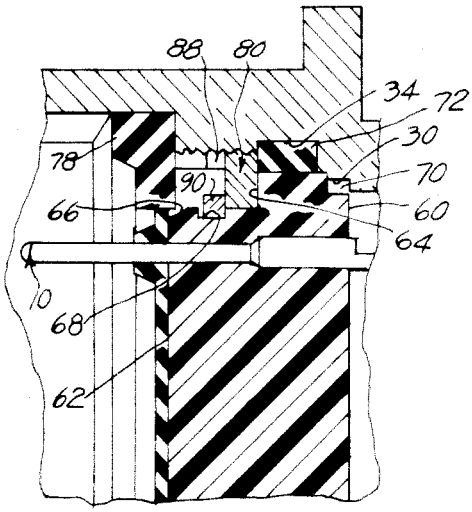
FIG. 4 is an enlarged view in section of the assembled receptacle shell shown in FIG. 2.

FIG. 4 is an enlarged view in section of the assembled receptacle shell shown in FIG. 3.

When assembled into the front end portion of the shell, the insert has its rear endface 60 abutting the shoulder 32 and its tabs 70 in the slots 30 to prevent relative rotation between the two. The O-ring 72 completes a moisture seal between the shell and the insert as it is dimensioned to be compressed within the annular groove 34. The locking nut 80 has its endwall 82 abutting against the shoulder 64 on the insert. The retaining ring 90 is received in the annular groove 68 of the insert to assist in backoff of the locking nut when the insert is to be removed from the shell.

Having thus described the invention what is claimed is:

1. An electrical connector comprising a metallic shell having a front and a rear end portion, a plurality of terminals disposed in the shell each having a forward and a rearward end portion, each forward end portion being releasably disposed in the front end portion of said shell and separable from its rearward end portion and each rearward end portion being non-removably mounted in the rear end portion of said shell, means for grounding the terminals to the shell, circuit protection means disposed on the forward end portion of each terminal and electrically connected to the grounding means for protecting the terminals from over voltages, filter means disposed on the rearward end portion of each terminal for protecting the terminals from frequency interference and access means for allowing removal of selected terminal end portions from the front end portion of the shell, the access means comprising the front end portion of said shell being internally threaded rearwardly of its front end face, a dielectric insert receiving the forward end portions of the terminals being disposed in the front end portion of said shell, and externally threaded locking means adapted to be releasably threaded into the front end portion of said shell for retaining the insert within the shell.

2. The electrical connector as recited in claim 1 wherein said locking means includes an externally threaded locking nut adapted to threadably engage the shell, an annular groove ons aid insert, and a retaining ring dimensioned to tightly fit in the groove and prevent unwanted backoff of the locking nut.

3. The electrical connector as recited in claim 1 wherein the locking means includes at least one L-shaped keyway extending rearwardly from the front endface of the locking nut, the keyway being adapted to be engaged by a like configured key from a tool inserted into the front end portion of the shell.

4. The electrical connector as recited in claim 1 wherein the insert includes an annular cam on its front face, the cam forcing a retaining ring inserted thereover to resiliently open for receipt within the annular recess around the insert.

5. The electrical connector as recited in claim 1 including alignment means for nonrotatably aligning the insert relative to the shell, said alignment means including an axial slot and a tab sized to fit said slot, said slot being on one of the insert or the shell, and said tab being on the other of the insert or the shell.

* * * * *